US006996990B2

(12) United States Patent
Dinu

(10) Patent No.: US 6,996,990 B2
(45) Date of Patent: Feb. 14, 2006

(54) FLOW CONTROLLER FOR GAS TURBINE COMBUSTORS

(75) Inventor: Constantin Alexandru Dinu, Greer, SC (US)

(73) Assignee: General Electric Company, Schnectady, NY (US)

( * ) Notice: Subject to any disclaimer, the term of this patent is extended or adjusted under 35 U.S.C. 154(b) by 199 days.

(21) Appl. No.: 10/648,203

(22) Filed: Aug. 27, 2003

(65) Prior Publication Data

US 2005/0044842 A1 Mar. 3, 2005

(51) Int. Cl.
*F23R 3/40* (2006.01)

(52) U.S. Cl. ..... 60/723; 60/749; 431/170

(58) Field of Classification Search ..... 60/39.11, 60/39.822, 723, 777, 749; 431/7, 170
See application file for complete search history.

(56) References Cited

U.S. PATENT DOCUMENTS 4,845,952 A 7/1989 Beebe
5,161,366 A * 11/1992 Beebe ..... 60/723
6,442,939 B1 * 9/2002 Stuttaford et al. ..... 60/723

* cited by examiner

*Primary Examiner*—Louis J. Casaregola
(74) *Attorney, Agent, or Firm*—Nixon & Vanderhye, P.C.

(57) ABSTRACT

A flow controller is disposed between a preburner section in a diffuser and prior to the main fuel injector and catalytic sections in a turbine combustor. The flow from the burner section is typically not uniform in temperature and velocity and the flow splitter renders the flow substantially uniform at the fuel injector and catalyst inlet. The flow splitter comprises substantially equal mass annular flow areas defined by a first outer frustoconical element and the diffuser wall, a second element defining with the first element a second annular area and a central bluff disk defining with the second element the interior annular area. Vanes are provided on the flow splitter to enhance turbulent flow and substantially preclude swirling flow. As a result, flow uniformity at the catalyst inlet and main fuel injection is achieved.

13 Claims, 3 Drawing Sheets

FLOW CONTROLLER FOR GAS TURBINE COMBUSTORS

BACKGROUND OF THE INVENTION

The present invention relates to combustors for gas turbines and particularly relates to a flow controller for promoting both velocity and temperature uniformity of combustion products flowing to the inlet of a catalyst.

Reduced emissions of nitrogen ($NO_x$) and hydrocarbon compounds in gas turbines is an ever-present goal. There are a number of different methods of reducing these emissions, all of which have certain drawbacks in terms of reduced turbine efficiency and increased costs. For example, steam can be injected into the combustor to reduce combustor flame temperature and hence minimize or eliminate the reaction of nitrogen in the air at elevated temperatures which produces the emissions. Steam injection, of course, requires ancillary costly equipment. Another method of reducing unwanted emissions is to provide a catalyst in the combustion products flow stream before exhausting to atmosphere. The catalytic reaction of the combustion products and the catalyst produce a number of harmless components and hence reduce unwanted emissions. A catalyst could also be used to enable combustion of very lean mixtures (usually below the flammability limit). The catalyst partially converts the fuel in a flame-less reaction such that the local temperatures within the catalyst and in downstream homogeneous combustion remain below the minimum temperature for $NO_x$ formation.

When using catalytic combustion to reduce emissions, it is highly desirable that the fuel/air distribution should be uniform at the inlet to the catalyst. Absent this flow uniformity in both velocity and temperature, uneven combustion with consequent reduction in combustor efficiency and increased emissions may occur. It will be appreciated that the output from the preburner section of a combustor has a center peaked flow distribution. That is, the flow distribution has a parabolic profile with the peak generally along the axial region of the combustor. Thus, the peak flow is characterized by both high velocity and high temperature. Additionally, the openings in the combustor liner tend to squeeze the flow toward the center axis of the combustor. Previous attempts to provide a uniform distribution of flow have included the use of perforated plates and honeycomb-type flow conditioners at the preburner exit. Also, multiple tubular-type venturi devices have been proposed in efforts to achieve a uniform flow. However, even utilizing multiple venturis such as described and illustrated in U.S. Pat. No. 4,845,952 does not entirely cure the problem of providing a uniform flow of fuel/air mixture to the catalyst inlet because the air flow can vary from venturi to venturi, with different mass flows, for example, peaking, along the central axial region of the combustor. Accordingly, there is a need for a device to promote flow uniformity in one or the other, and preferably both, of velocity and temperature flow parameters at the inlet to the catalyst.

BRIEF DESCRIPTION OF THE INVENTION

In accordance with a preferred embodiment of the present invention, there is provided a flow controller disposed in the flow stream at a location intermediate the preburner and the catalyst inlet. A principal function of the flow controller is to redistribute the flow radially to disperse the center peak. This is accomplished by a preferential radial distribution of the effective area through the flow controller. Moreover, the flow controller assists to develop a wall jet along the diverging liner wall of the combustor which minimizes or eliminates the potential for flow separation. Further, the air flowing into the flow controller and particularly when the preburner is utilized, is a swirling flow. The flow controller includes vanes which extend radially and are angled to promote uniformity of flow in a circumferential direction. Thus, the blockage areas of the flow controller and the vanes generate intense global turbulence downstream from the controller that promotes thermal and momentum mixing. While preferably the vanes are rotated in a direction counter to the direction of the swirl of the flow, which intensifies mixing and reduces rotation, the vanes may be angled in the opposite direction, i.e., the same direction as the nozzle swirl. The latter may have a positive impact where minimum flow disturbance is sought and general swirl is not a concern.

More particularly, the flow controller includes a flow splitter including a central flow disk and a pair of annular elements spaced radially from one another and the central disk to provide discrete flow areas through the splitter. The center disk provides a bluff center area which smoothes out the peak and displaces the flow toward the liner wall. The outermost or first annular element is spaced from the liner wall and is in the form of a frustoconical section having its larger diameter in a downstream direction. This first or outer ring confines the flow close to the liner wall and accelerates the flow in that region to avoid downstream separation of the flow from the liner wall. This is particularly important since the liner wall is generally divergent in a downstream direction, tending to separate the flow from the liner wall.

A further feature of the splitter resides in the preferential radial distribution of the effective flow areas through the splitter. The annular areas provided by the first and second elements and the disk provide substantially the same mass flow in a downstream direction through each annular area. Additionally, radial vanes are provided on the splitter which afford uniformity of flow in a circumferential direction. The radial vanes incline in a direction opposite to the swirl provided by the preburner and straighten the flow, thereby providing additional mixing with consequent uniform temperature and velocity distribution in the downstream direction. Holes are provided through the center disk in a predetermined pattern to control the separation region downstream of the central disk and accommodate variations in combustor operation such as startup and at full load. The holes through the center disk are differentially spaced and vary in the radial direction. The center disk hole arrangement is preferably in two annular rings. The different operating conditions cause concentric peaks in the flow and the holes through the disk are arranged and configured to accommodate the peaks to afford a more uniform flow distribution exiting the flow controller. It will be appreciated that while in the present application the design seeks flow uniformity, the effective area of the splitter could be distributed in such a way as to accomplish other desired flow profiles at a certain distance downstream.

In a preferred embodiment according to the present invention, there is provided a combustor for a gas turbine comprising a preburner section for receiving fuel and air for combustion therein, a main fuel injector, a catalyst section downstream of the preburner section and in a flow stream including fuel from the main fuel injector and air and products of combustion from the preburner section, a flow liner encompassing the flow stream between the preburner section and the catalyst section, a flow controller disposed intermediate the preburner section and the catalyst section for obtaining a substantial uniform flow distribution at an inlet to the catalyst section, the flow controller including a flow splitter disposed in the flow stream and including first and second elements at least in part defining first and second annular flow areas through the splitter, the first element including a generally radially outwardly directed frustoconical wall in the downstream direction of the flow stream defining with the liner the first annular flow area to substantially eliminate or minimize separation of the flow stream downstream of the flow controller and relative to the liner.

In a further preferred embodiment according to the present invention, there is provided a combustor for a gas turbine comprising a preburner section for receiving fuel and air for combustion therein, a main fuel injector, a catalyst section downstream of the preburner section and in a flow stream including fuel from the main fuel injector and air and products of combustion from the preburner section, a flow liner encompassing the flow stream between the preburner section and the catalyst section, a flow controller disposed intermediate the preburner section and the catalyst section for obtaining a substantial uniform flow distribution at an inlet to the catalyst section, the preburner section imparting a swirling pattern to the flow of air and combustion products having a center peak flow velocity along a central region of the liner, the flow controller having a plurality of discrete flow-through areas to preferentially radially distribute the flow to disperse the center peak and produce a more uniform velocity distribution as compared with the velocity distribution of the flow of air and combustion products upstream of the flow controller.

DETAILED DESCRIPTION OF THE INVENTION

Figure 1:
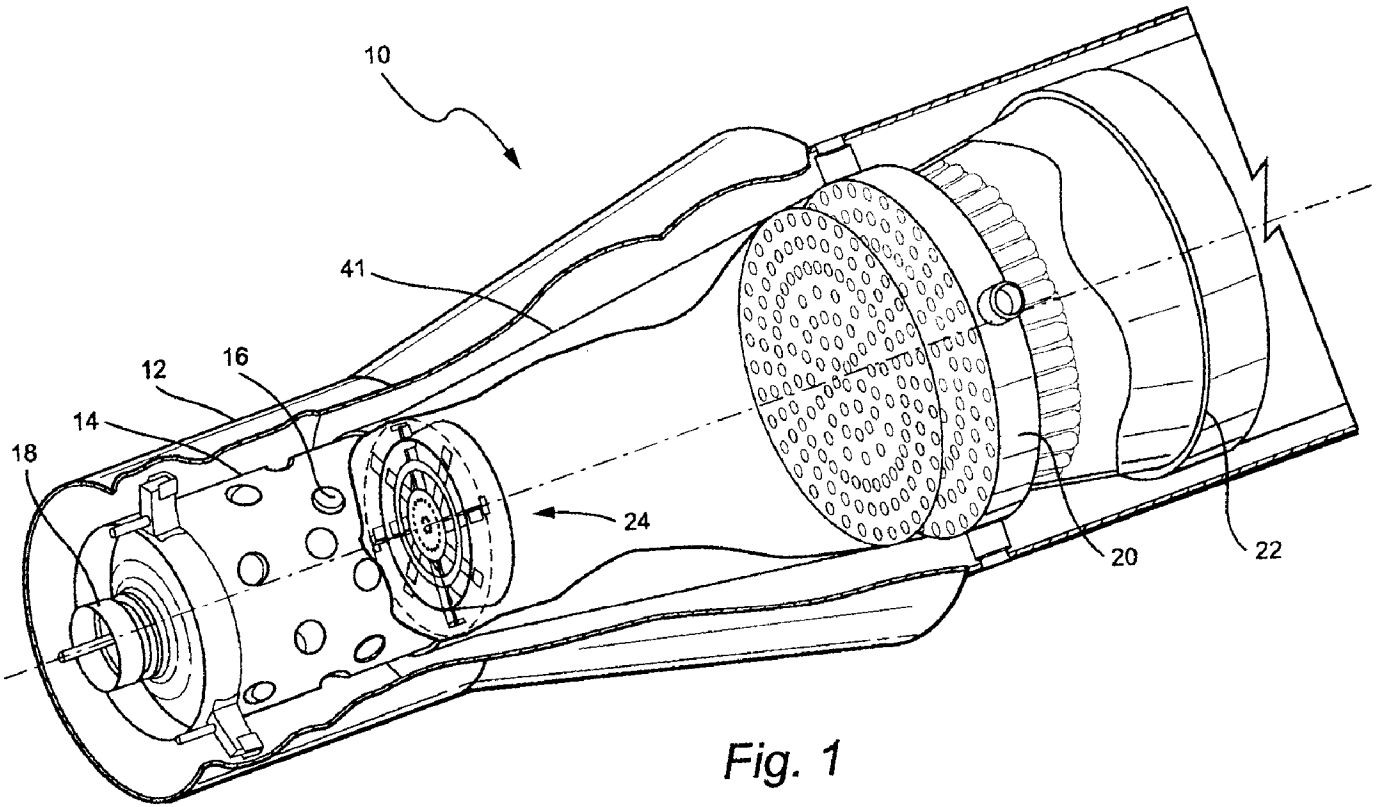
FIG. 1 is a fragmentary perspective view with parts broken out and in cross-section of a combustor for a gas turbine incorporating a flow controller according to a preferred embodiment of the present invention.

As will be appreciated a typical gas turbine has an array of circumferentially spaced combustors about the axis of the turbine for burning a fuel/air mixture and flowing the products of combustion through a transition piece for flow along the hot gas path of the turbine stages whereby the energetic flow is converted to mechanical energy to rotate the turbine rotor. The compressor for the turbine supplies part of its compressed air to each of the combustors for mixing with the fuel. One of the combustors for the turbine is illustrated in FIG. 1 and it will be appreciated that the remaining combustors for the turbine are similarly configured. Smaller gas turbines could be configured with only one combustor having the configuration shown in FIG. 1.

Referring to FIG. 1, a combustor, generally designated 10, includes a preburner section 12 having an interior flow liner 14. Liner 14 has a plurality of holes 16 for receiving compressor discharge air for flow in the preburner section 12. Preburner section 12 also includes a preburner fuel nozzle 18 for supplying fuel to the preburner section. As explained previously, the flow, e.g., combustion products, from the preburner section has a center peaked flow distribution, i.e., both flow velocity and temperature, which does not result in the desired uniform flow to the additional gas fuel injectors, e.g., the venturi-type fuel injectors described and illustrated in U.S. Pat. No. 4,845,952. The main fuel injector is designated 20 in FIG. 1 and may be of the type disclosed in that patent. The air and products of combustion from the preburner section 12 and the fuel from the fuel injector 20 flow to the catalyst or catalytic section 22. As a consequence, there is a lack of uniformity of the flow at the inlet to the catalytic section 22. To provide such uniformity, a flow controller, generally designated 24, is provided between the preburner section 12 and the fuel injector 20 and catalytic section 22.

Figure 3:
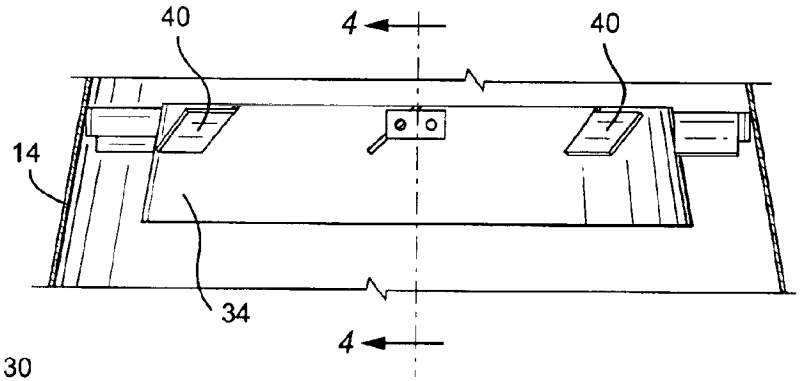
FIG. 3 is a diametrical cross-sectional view of the flow controller of FIG. 2.
Figure 4:
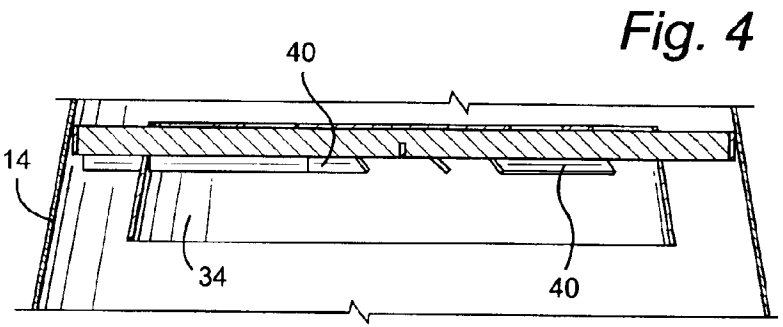
FIG. 4 is a cross-sectional view thereof taken generally about on line 4—4 in FIG. 3.
Figure 2:
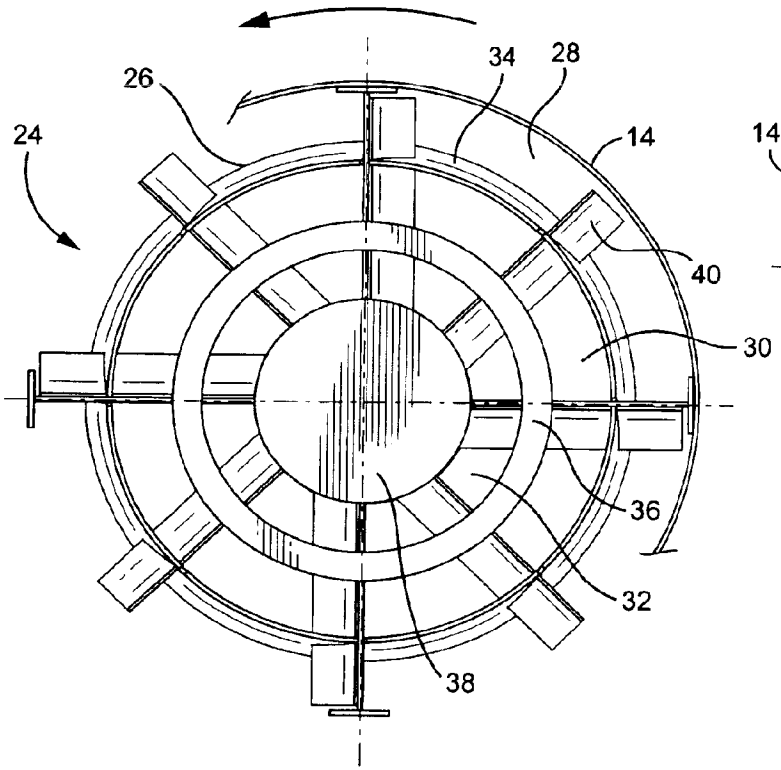
FIG. 2 is an axial view looking downstream of the flow controller with portions of the combustor liner being illustrated.

Referring now to FIGS. 2–4, the flow controller 24 is disposed in the diverging section of the flow liner 14 and includes a flow splitter 26 defining three annular flow areas 28, 30 and 32 through the controller 24. The annular flow area 28 is defined between the liner 14 and a first flow element 34, preferably in the shape of a frustoconical ring. The larger diameter of the flow element 34 lies on its downstream end. The second annular flow area 30 is defined between the first annular element 34 and a smaller diameter interiorly located annular element or ring 36. The third annular flow area 32 is defined between the ring 36 and a central disk 38. The three annular flow areas 28, 30 and 32 are chosen so that substantially the same mass flow passes through each of the annular flow areas. Additionally, the flow splitter includes a plurality of generally radially extending vanes 40 which extend from the center disk 38 to project radially outwardly, terminating short of the liner wall 14. The vanes are angled, as best illustrated in FIG. 3, preferably in an angular direction opposite to the rotational direction of the flow from the preburner section. By angling vanes 40 in this manner, the rotational flow from the preburner section is straightened and has the additional advantage of affording an interaction between the two counter-rotating swirling flows to promote large-scale mixing to effectively achieve uniform flow downstream of the splitter. In certain applications where there is very low swirl or swirling flow from the preburner is absent, the vanes 40 could be omitted entirely as in FIG. 5.

It will be appreciated that the mass flow through each of the annular flow areas 28, 30 and 32 is substantially the same. It will also be appreciated from a review of FIG. 4 that the first element 34, i.e., the frustoconical element 34, has a longer axial extent than the second element 36 and central disk 38, as well as the vanes 40. This frustoconical section 34 confines the flow between the cone and the inner wall surface of the divergent wall portion 41 of liner 14, imposing a higher momentum to the flow and directing the flow along the diverging liner wall to substantially minimize or eliminate flow separation along the wall. Because the liner is part of a diffuser section, the flow emanating from the liner into the venturi-shaped diffuser section would normally tend to separate from the interior wall portion 41 of the flow liner 14. Without the frustoconical first element 34 of the flow splitter, the flow along the liner wall portion 41 would have a low velocity and a differential fuel/air mixture as the flow entered the catalyst section, i.e., the fuel injector would inject roughly the same amount of fuel but there would be less air in the fuel/air mixture along the outer diameter and therefore a higher fuel/air ratio of the flow entering the catalytic section along its outer diameter regions. Thus, the frustoconical element 34 directs the flow along the divergent liner wall portion 41 and substantially eliminates or minimizes flow separation therefrom. Further, the vanes 40 straighten out the swirl flow and promote large-scale mixing of the flow downstream which will promote temperature uniformity.

Figure 5:
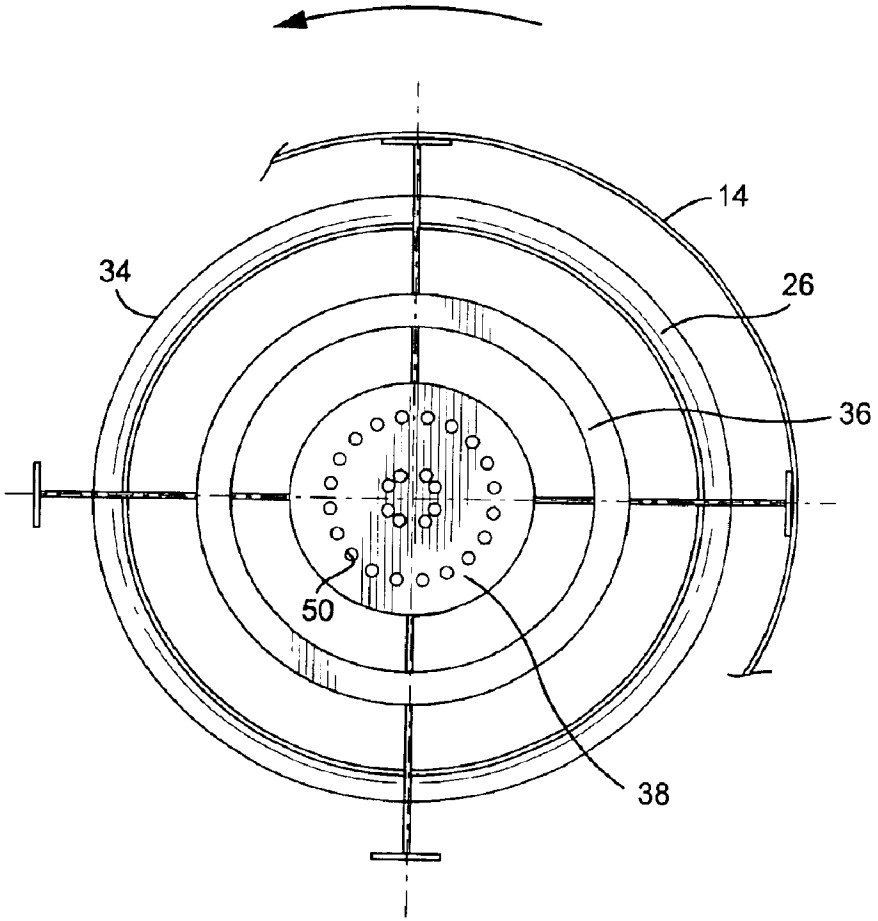
FIG. 5 is an axial view of the flow controller similar to FIG. 2 illustrating a perforated center disk.

Referring to FIG. 5, it will be appreciated that the combustor operates at a large range of loads and operating conditions and, thus, for any one condition, the flow controller may not be optimum. To accommodate these flow conditions, the central disk 38 may be provided with a plurality of holes 50 through the disk. The arrangement of two essentially radially spaced, circumferentially extending rows of holes illustrated in FIG. 5 assists in accommodating the different operating conditions to the end that a uniformity of flow occurs at the catalyst inlet.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor for a gas turbine comprising:

a preburner section for receiving fuel and air for combustion therein;

a main fuel injector;

a catalyst section downstream of the preburner section and in a flow stream including fuel from the main fuel injector and air and products of combustion from the preburner section;

a flow liner encompassing the flow stream between the preburner section and the catalyst section;

a flow controller disposed intermediate the preburner section and the catalyst section for obtaining a substantial uniform flow distribution at an inlet to the catalyst section;

said flow controller including a flow splitter disposed in the flow stream and including first and second elements at least in part defining first and second annular flow areas through the splitter, said first element including a generally radially outwardly directed frustoconical wall in the downstream direction of the flow stream defining with said liner said first annular flow area to substantially eliminate or minimize separation of the flow stream downstream of the flow controller and relative to the liner.

2. A combustor according to claim 1 wherein said first and second annular flow areas are configured to provide substantially the same mass flow.

3. A combustor according to claim 1 wherein said flow controller includes generally radially extending vanes circumferentially spaced from one another and angled to the direction of flow.

4. A combustor according to claim 1 wherein said first and second annular flow areas are configured to provide substantially the same mass flow, said flow controller including generally radially extending vanes circumferentially spaced from one another and angled to the direction of flow to remove flow swirl from the flow stream.

5. A combustor according to claim 1 wherein said flow controller includes a central disk along a centerline of the flow stream.

6. A combustor according to claim 5 wherein said first and second elements lie radially spaced from one another and said disk, said first element lying radially outwardly of said second element and said disk and a plurality of generally radially extending vanes circumferentially spaced one from the other and angled to the direction of flow.

7. A combustor according to claim 1 wherein said preburner section imparts a swirl to the flow, said flow splitter including generally radially extending vanes circumferentially spaced one from the other and angled relative to the flow.

8. A combustor for a gas turbine comprising:

a preburner section for receiving fuel and air for combustion therein;

a main fuel injector;

a catalyst section downstream of the preburner section and said main fuel injector and in a flow stream including fuel from the main fuel injector and air and products of combustion from the preburner section;

a flow liner encompassing the flow stream between the preburner section and the catalyst section;

a flow controller disposed intermediate the preburner section and the main fuel injector for obtaining a substantial uniform flow distribution at an inlet to the catalyst section;

the preburner section imparting a swirling pattern to the flow of air and combustion products having a center peak flow velocity along a central region of said liner, said flow controller having a plurality of annular elements defining a plurality of discrete annular flow-through areas to preferentially radially distribute the flow to disperse the center peak and produce a more uniform velocity distribution as compared with the velocity distribution of the flow of air and combustion products upstream of the flow controller.

9. A combustor according to claim 8 wherein said discrete annular flow-through areas are radially spaced from one another and each provide substantially the same mass flow as another of the flow-through areas.

10. A combustor according to claim 8 wherein said flow controller includes generally radially extending vanes circumferentially spaced from one another and angled to the direction of flow.

11. A combustor according to claim 10 when in said discrete flow-through areas each provide substantially the same mass flow as another of the flow-through areas.

12. A combustor according to claim 8 wherein said flow controller includes a central disk along a centerline of the flow stream.

13. A combustor according to claim 12 wherein said flow controller includes generally radially extending vanes circumferentially spaced from one another and angled to the direction of flow, said flow-through areas being radially spaced from one another and said disk.

* * * * *

UNITED STATES PATENT AND TRADEMARK OFFICE

CERTIFICATE OF CORRECTION

PATENT NO. : 6,996,990 B2
DATED : February 14, 2006
INVENTOR(S) : Dinu

It is certified that error appears in the above-identified patent and that said Letters Patent is hereby corrected as shown below:

Column 6,
Line 50, delete "when in" and insert -- wherein --.

Signed and Sealed this

Twenty-third Day of May, 2006

JON W. DUDAS
*Director of the United States Patent and Trademark Office*